United States Patent [19]

Evans

[11] 4,189,872

[45] Feb. 26, 1980

[54] ABRADING APPARATUS AND METHOD HAVING INDUCED AIR

[75] Inventor: F. David Evans, Eugene, Oreg.

[73] Assignee: Kimwood Corporation, Cottage Grove, Oreg.

[21] Appl. No.: 912,365

[22] Filed: Jun. 5, 1978

[51] Int. Cl.[2] ..... B24B 21/00; B24B 1/00

[52] U.S. Cl. ..... 51/135 R; 51/142; 51/356; 51/328

[58] Field of Search ..... 51/135 R, 135 BT, 141, 51/142, 170 EB, 262 R, 262 A, 266, 270, 273, 328, 356

[56] References Cited

U.S. PATENT DOCUMENTS

| | | | |
|---|---|---|---|
| 1,493,779 | 5/1924 | Humphreys | 51/141 |
| 2,594,647 | 4/1952 | Hendrickson | 51/135 R |
| 2,883,804 | 4/1959 | Hjelstrom et al. | 51/135 R |
| 3,030,744 | 4/1962 | Mueller | 51/225 |
| 3,408,775 | 11/1968 | Rutt | 51/141 |
| 3,646,712 | 3/1972 | Quintana | 51/273 |
| 3,694,966 | 10/1972 | Heesemann | 51/141 |
| 3,907,257 | 9/1975 | Drzewiecki | 51/266 |

FOREIGN PATENT DOCUMENTS

| | | | |
|---|---|---|---|
| 535506 | 4/1941 | United Kingdom | 51/170 EB |

*Primary Examiner*—Harold D. Whitehead
*Assistant Examiner*—K. Bradford Adolphson
*Attorney, Agent, or Firm*—Kolisch, Hartwell, Dickinson & Stuart

[57] ABSTRACT

In apparatus for abrading a workpiece including a central support member having a power-driven contact roll and an idler roll mounted thereon, and an endless, abrasive belt trained over the rolls with an air space being defined between inside surfaces of the belt and the central support member, an improvement which includes pressurizing the air space for maintaining same at a pressure greater than the prevailing air pressure adjacent the outside surfaces of the belt to substantially prevent inflow of abraded debris to the air space.

11 Claims, 6 Drawing Figures

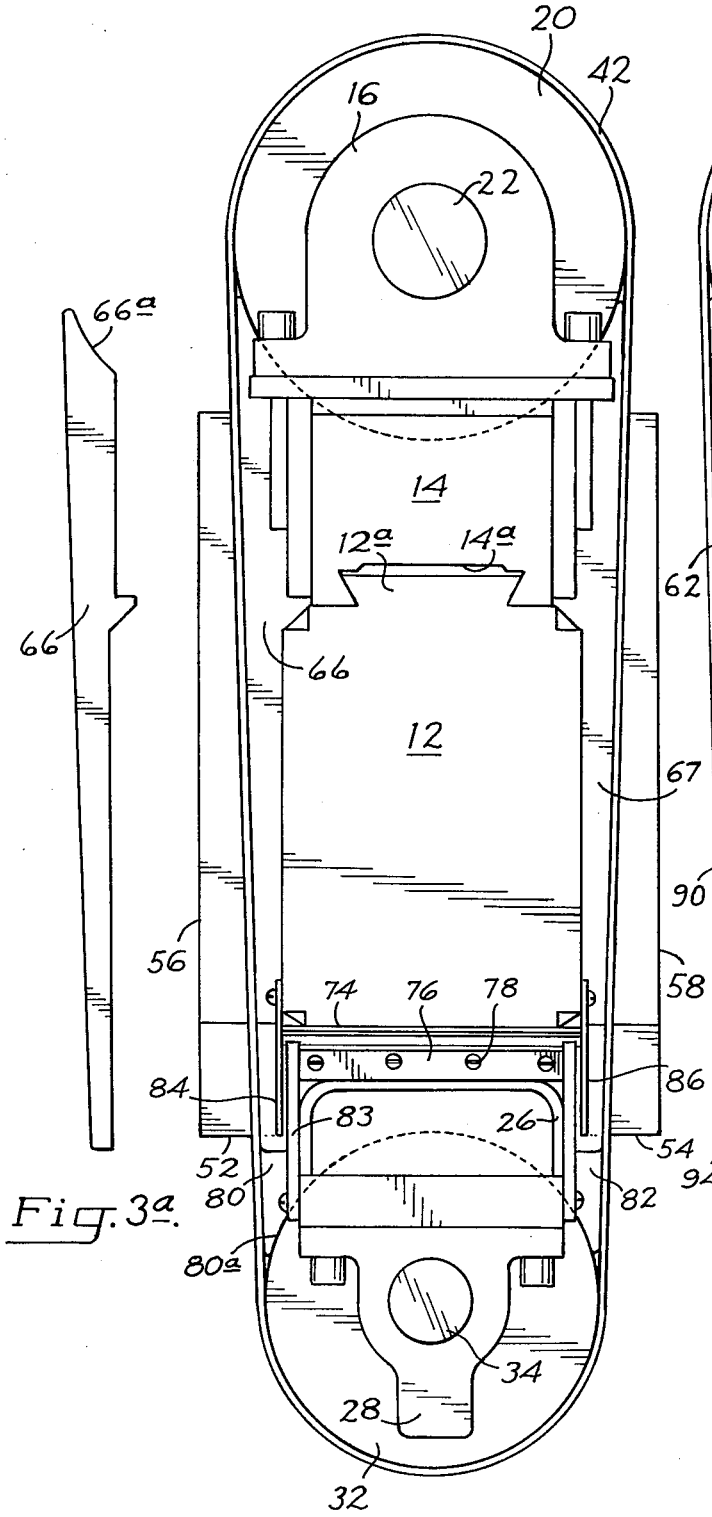
Fig. 3a.
Fig. 3.
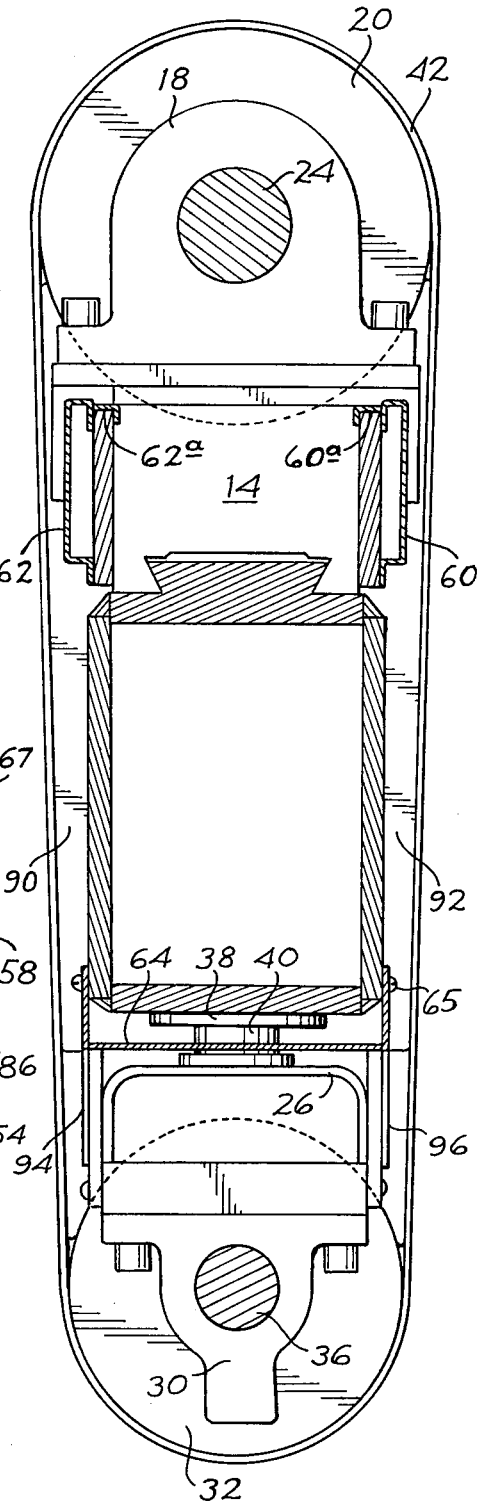
Fig. 4.

ABRADING APPARATUS AND METHOD HAVING INDUCED AIR

BACKGROUND AND SUMMARY OF THE INVENTION

The present invention relates to abrading apparatus of the type having an endless belt trained over a pair of spacedapart contact and idler rolls, and more particularly to an improved method and apparatus which includes provision for preventing the accumulation of abraded debris on the inside surfaces of the belt.

Conventional belt-type abrading apparatus include a power-driven contact roll and an idler roll mounted on a central support member which is connected to a frame structure. An endless, abrasive belt is trained over the rolls and an air space is defined between the central support member and inside surfaces of the belt. Operation of the contact roll will simultaneously impart motion to the belt. Typically, such abrading apparatus will also include a mechanism for oscillating the idler roll about an axis extending perpendicularly to the longitudinal axis of the idler roll. The oscillation causes a traveling belt to shift slightly back and forth so that belt imperfections do not result in streak marks or other flaws on abraded workpieces. The movement of the belt is commonly referred to as "steering".

A problem existing in the operation of abrading apparatus as described above results from the inflow of abraded debris from a workpiece into the air space located between inside surfaces of the belt. Apparently, abraded debris tends to be drawn into the air space due to movement of the belt which creates a lower pressure area adjacent the belt's edges. Additionally, in abrading apparatus used to abrade the lower surface of a workpiece (referred to as a "lower head"), it can be appreciated that abraded debris will migrate into the air space by virtue of gravity. The inflow of abraded debris to the air space results in a build up of the debris on the inside surfaces of the belt.

If the workpiece is lumber of a particularly resinous species, such as, for example, Ponderosa pine (*Pinus ponderosa*), the debris or fibers rapidly accummulate and adhere to the inside surfaces of the belt (as well as on the rolls) and prevent the belt from steering during oscillation of the idler roll. Steering is impeded because the rolls do not have a smooth surface and the belt will not shift readily therealong. Prevention of steering may result in the belt folding up on itself or creasing which may cause a split permanently damaging the belt.

In addition, the build up of abraded debris or fibers on the inside surfaces of the belt may result in shortened belt life because the inside surfaces are subjected to more wear and strain as they travel around the rolls. As a consequence, it is necessary to periodically remove abrasive belts and subject them to burdensome cleaning procedures. Of course, changing and cleaning of the belts and rolls is time consuming, and mill down time because of repairs to abrading apparatus is uneconomical.

Further, it should be noted that with accumulation of abraded debris or fibers as described above, an abrasive belt may have a relatively short life. For instance, it has been found that the maximum operating life for an abrasive belt in conditions resulting in debris accummulation on the belt is approximately 8 hours. It can readily be appreciated that prevention of accumulation of abraded debris on the inside surfaces would result in significantly longer belt life as well as preventing creasing and splitting of a belt during idler roll oscillation. Of course, longer belt life would also result in less down time required to change belts.

Accordingly, it is a general object of the present invention to improve conventional belt-type abrading apparatus so that the air space existing between the central support member and the inside surfaces of the belt is maintained at a pressure greater than the prevailing air pressure adjacent the outside surfaces of the belt. By maintaining the greater pressure in the air space, abraded debris will be prevented from inflowing to the air space and consequently accumulation of debris on the inside surfaces of the belt will be prevented. Accumulation on the rolls will also be eliminated. Unimpeded "steering" will be ensured and intervals required between belt cleaning will be significantly increased.

More particularly, it is an object of the present invention to provide a method and apparatus including a pressurizing means which utilizes an air mover means communicating with a duct means for delivering or inducing air into the air space on both sides of the central support member. It may be appreciated that the induced air will sweep over the inside surfaces of the belt and ensure that accumulation of abraded debris does not occur.

Another object of the present invention is to provide sealing means provided adjacent opposite ends of each roll and on opposite sides of the central support member for substantially sealing the air space. In effect, a plenum chamber will be created upon the introduction of air through the duct means, and this will prevent inflow of abraded debris. The sealing means will permit leakage of air outwardly from the air space, but will not permit inflow of abraded debris.

These and additional objects and advantages of the present invention will be more clearly understood from a consideration of the drawings and the detailed description of the preferred embodiment.

BRIEF DESCRIPTION OF THE DRAWINGS

FIG. 3 is an end elevation view taken along lines 3—3 of FIG. 1;

FIG. 3*a* is an isolated view of one sealing means or sealing strip used to seal the air space;

FIG. 4 is a cross-sectional view taken along lines 4—4 of FIG. 1.

DETAILED DESCRIPTION OF THE PREFERRED EMBODIMENT

Figure 1:
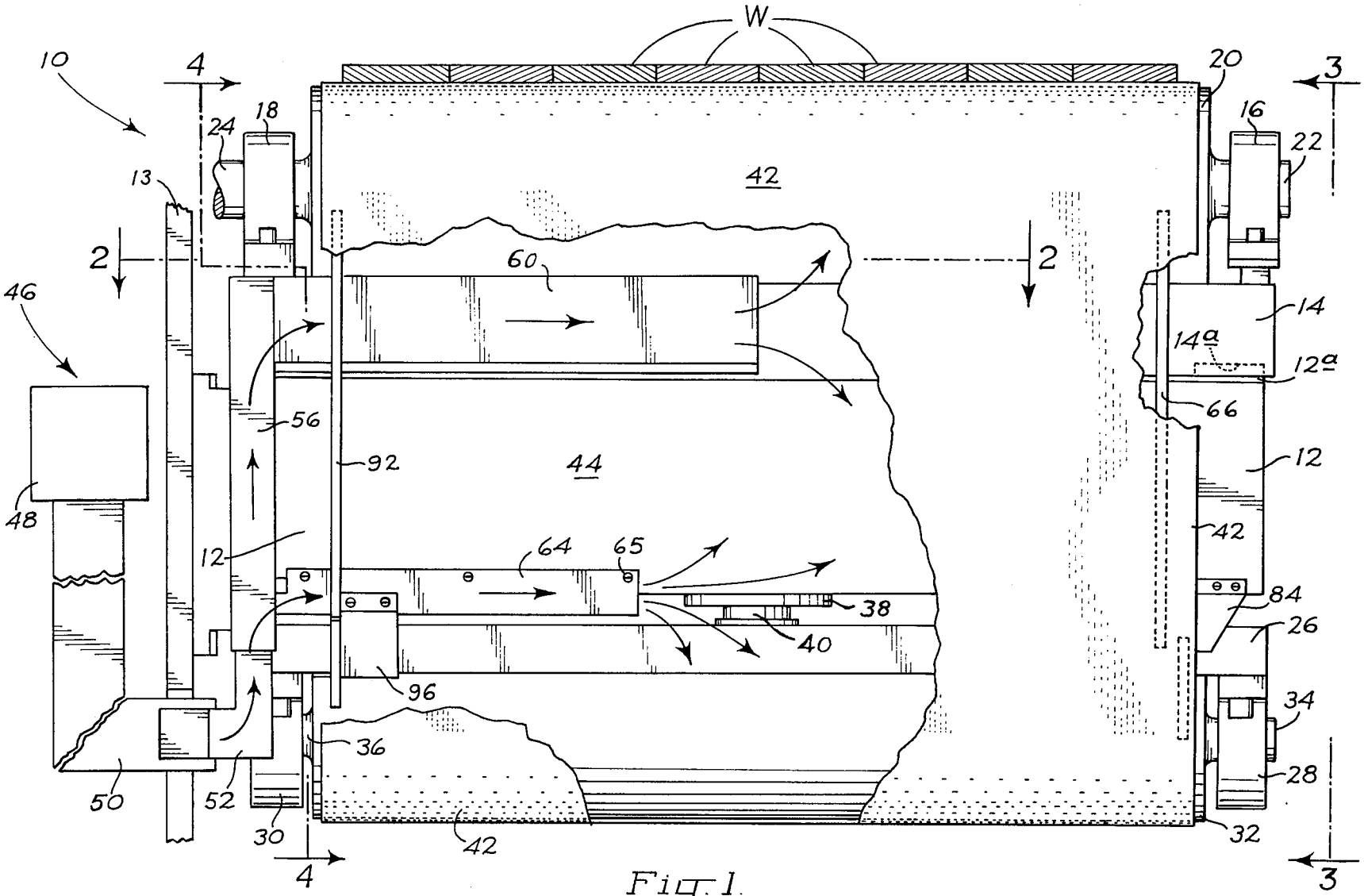
FIG. 1 is a front elevation view, partially broken away, illustrating a belt abrading apparatus (in the lower head configuration) provided with duct work for discharging air delivered from an air mover into the air space between the inside surfaces of the apparatus' abrasive belt.

Turning now to the drawings, reference is initially directed to FIG. 1 which illustrates an abrading apparatus, generally designated at 10, incorporating a pressurizing means in accordance with the present invention. A brief description of apparatus 10, with respect to its conventional components will now be made.

As shown, apparatus 10 is of the lower head type utilized for abrading a bottom surface of a workpiece, a plurality of workpieces being indicated at W. Apparatus 10 includes a central, support member 12 which extends, in cantilever manner, from a frame structure 13. Only a portion of the frame structure is illustrated as such is conventional. With reference also directed to FIG. 3, it can be seen that central support section 12 supports a mounting 14 which is provided with an opening 14*a* on opposite ends (only one being illustrated) for accommodating a key 12*a* formed on support member 12. Mounting 14 extends across the length of apparatus 10 and provides a support for opposed, spaced-apart pillow blocks 16, 18. A contact roll 20 is rotatably journaled by means of a stubshaft 22 mounted in pillow block 16 and a drive shaft 24 mounted in pillow block 18. Only a portion of drive shaft 24 is illustrated as it is conventionally driven.

Mounted beneath central support member 12 is an elongate member 26 from which depend opposed, spaced-apart pillow blocks 28, 30. An idler roll 32 is provided with stubshafts 34, 36 for rotatable mounting in pillow blocks 28, 30 respectively. As is conventional, a cylinder 38 extends upwardly inside of central support member 12 and includes a piston rod 40 extending downwardly therefrom which is secured to elongate member 26. Piston rod 40 may be suitably extended and retracted as well as oscillated about its longitudinal axis. Oscillation of piston rod 40 will simultaneously oscillate elongate member 26 and idler roll 32.

Trained around contact roll 20 and idler roll 32 is an endless, abrasive belt 42 which continuously travels during operation of contact roll 20. As is conventional, oscillation of piston rod 40 will impart simultaneous oscillation to idler roll 32 and will "steer" belt 42 back and forth along the cylindrical axis of both rolls.

It may be appreciated that an air space exists between inside surfaces of belt 42 and opposite sides of central support member 12 extending from contact roll 20 to idler roll 32. Generally, an air space on the side shown in FIG. 1 is indicated at 44 and another air space exists on the opposite side. It is the pressurizing of the air spaces by inducing air into same that is the essential feature of the improvement of the present invention.

Figure 2:
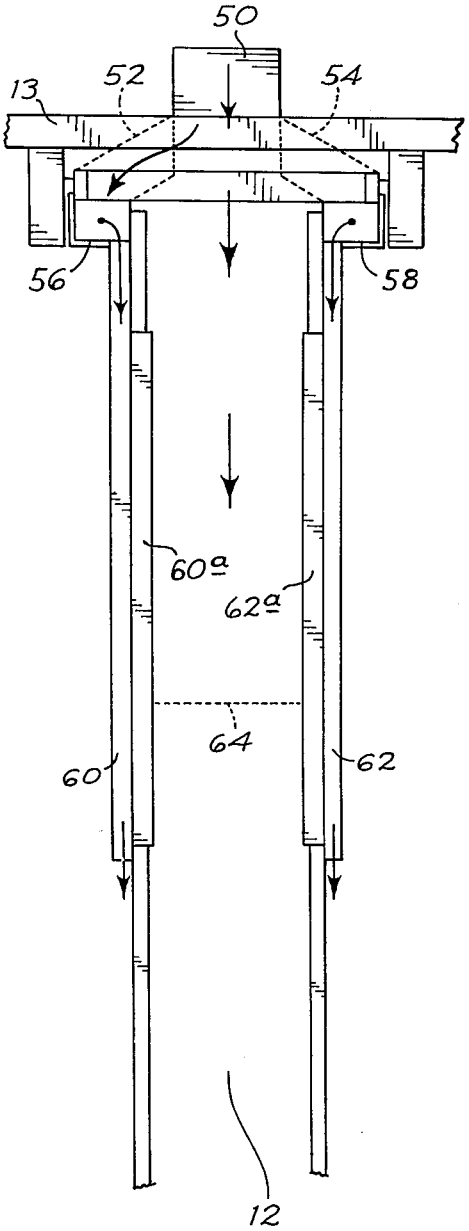
FIG. 2 is a top plan view taken along lines 2—2 of FIG. 1 and illustrates positioning of duct work adjacent the apparatus' contact roll.

Explaining further, and with reference also directed to FIG. 2, a pressurizing means for use with apparatus 10 is generally indicated at 46 and includes an air mover means 48 communicating with duct means including an inlet duct 50 which extends into branches 52, 54 turning up into transfer ducts 56, 58 respectively. The duct means also includes a first duct section having a pair of ducts 60, 62 which are mounted on opposite sides of central support member 12 and extend, respectively, from transfer ducts 56, 58 to a position adjacent contact roll 20. The positioning of ducts 60, 62 is facilitated by the provision of flange members 60*a*, 62*a* which are correspondingly suspended from and retained on opposed plate members provided on mounting 14. Ducts 60, 62 are rectangular in cross-section and, as shown with reference to duct 60 in FIG. 1, extend from the left hand side to a discharge position approximately midway the length of the belt width dimension.

A second duct section 64, also of rectangular cross-section, communicates with inlet duct 50, for discharging air adjacent idler roll 32. It is to be noted that second duct section 64 extends beneath a bottom surface of central support member 12 and discharges air adjacent cylinder 38. Second duct section 64 is dimensioned to provide an opening which approximates the width of central support member 12 and is secured by suitable fasteners 65 thereto. Considering ducts 60, 62 and 64, it can be seen that air may be discharged to sweep over the air spaces existing between the inside surfaces of belt 42 and the sides of central support member 12.

As referred to previously, it is desirable to substantially seal the air spaces so that a plenum chamber is provided. To this end, sealing means are provided adjacent opposite ends of contact roll 20 and idler roll 32 and on opposite sides of central support member 12. Explaining further, and with reference particularly directed to FIGS. 3 and 5, it may be seen that an elongate sealing strip 66 is mounted to central support member 12 by means of brackets 68, 70. The brackets are suitably mounted to either the central support member or mounting 14. As can be seen in FIG. 3*a*, sealing strip 66 is provided with an arcuately shaped upper end portion 66*a* for conforming to a peripheral portion of contact roll 20. Another sealing strip 67 is shown mounted on the other side of central support member 12.

Additionally, in order to somewhat perfect the sealing, it is necessary to provide for the gap which exists between the bottom of central support member 12 and the top of elongate member 26. To seal this gap, it is necessary to provide a sealing member or sealing construction which extends across the gap. Such a sealing member (of flexible material) is indicated at 74 and is secured along one end thereof to a transversely extending member 76 by means of suitable screws 78. Member 76 interconnects with additional sealing members 80, 82 which are connected to elongate member 26. For instance, sealing member 80 is connected to elongate member 26 by means of a bracket 83. It is to be noted that sealing members 80, 82 are also provided with arcuately shaped end portions (such as end portion 80*a* on sealing member 80) for conforming generally to a peripheral portion of idler roll 32.

Figure 5:
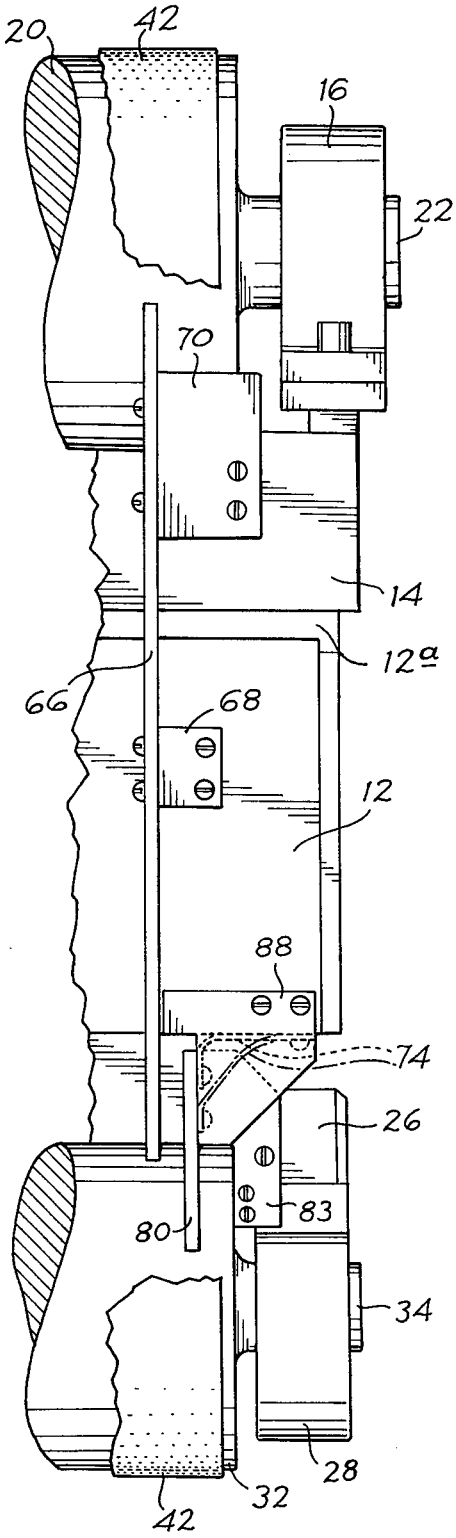
FIG. 5 is an enlarged, front elevation view, of only a portion of the right hand end of FIG. 1.

Further, it is necessary to provide additional flexible sealing members such as flaps 84, 86 on opposite sides of central support member 12 adjacent elongate member 26 (see FIGS. 3 and 5). As shown, flap 84 is secured by means of a bracket 88 to central support member 12. It is necessary to provide flaps 84, 86 so that they overlap sealing member 74. It is also to be noted that sealing member 74 is constructed of flexible material and will move with elongate member 26 upon extension or retraction of piston rod 40 and still provide sealing. As depicted in FIG. 5, sealing member 74 is positioned with the bulk of its length flush against the bottom of central support member 12 because piston rod 40 is almost fully retracted. However, it can be appreciated that upon further extension of the piston rod, sealing member 74 will be urged downwardly (as shown in dot-dash) but nonetheless will have its sides covered by flaps 84, 86.

While only one end of apparatus 10 has been described with reference to sealing means, it should be appreciated that the other end is provided with similar sealing means. For instance, as shown in FIGS. 1 and 4, a pair of sealing strips 90, 92 are mounted on central support member 12 and flaps 94, 96 are secured to second duct section 64.

Sealing members 66, 67, 80, 82, 90, 92 etc. are preferably formed of plastic material or other material which will permit relatively friction-free movement thereover of belt 42. Further, as can be seen from a consideration of FIG. 5, belt 42 overlaps to the outside of sealing members 66, 80. An absolutely airtight air space is not essential, but it should be appreciated that introduction of air through the various ducts will serve to increase the pressure in the air spaces and thus tend to create, in effect, a plenum chamber.

Several important advantages of the present invention, as described above, will now be briefly reviewed. Assuming continuous travel of belt 42 for purposes of abrading a bottom surface of workpieces W, it is apparent that abraded debris will tend to be drawn toward the interior of the belt. This phenomenon may be explained by low pressure regions surrounding the edge of the belt due to its movement as well as gravitational effects. Similarly, if upper surfaces of workpieces W are being simultaneously abraded, as is typically the case, additional abraded debris will tend to migrate toward interior surfaces of belt 42. However, as contemplated by the present invention, air mover means 48 will be continuously operating to deliver air through the duct means so that air is discharged into the air space. This discharge will tend to pressurize the air space and create a plenum chamber, especially in view of the fact that the sealing means further isolates the air space volume.

Thus, it can be appreciated that as abraded debris is drawn toward the interior surfaces of belt 42, such debris will be impeded from entering the air space volume because of air moving outwardly from the volume. It has been found that utilization of the pressurizing means of the present invention eliminates abraded debris accumulation on the inside surfaces of belt 42 within the confines of the air space volume as well as accumulation on the surfaces of the contact and idler rolls. In the case of lumber, and particularly lumber having a high resinous content, elimination of debris build up not only permits trouble free "steering" of belt 42 during oscillation of idler roll 32, but also substantially increases the intervals between belt cleaning and repair. As explained previously, cleaning of a belt requires considerable down time for its removal and treatment.

Another advantage of the present invention resides in the relative simplicity of providing a belt type abrading apparatus with a pressurized means as above described. More specifically, the above description refers to a retrofit of an existing belt-type abrading apparatus. It is only necessary to mount an air mover means and simple duct work, which may be readily attached to component parts of the apparatus, and then to provide sealing means. This may be accomplished as a retrofit or may be part of the apparatus as original equipment. In any event, it is clear that no complicated mechanisms or time consuming and expensive modifications are necessary in order to provide a pressurizing means which will substantially prevent inflow of abraded debris to the apparatus' air space volume.

Still another advantage of the present invention resides in the provision of the sealing members which are formed as sealing strips in which ends of the strips are provided with an arcuate portion for substantially conforming to a peripheral portion of an associated contact roll or idler roll. Mounting of the strips is a simple matter and ensures that an adequate plenum chamber will be provided during operation of the air mover means.

While the present invention has been particularly shown and described with reference to the foregoing preferred embodiment, it will be understood by those skilled in the art that other changes in form and detail may be made therein without departing from the spirit and scope of the invention as defined in the appended claims.

It is claimed and desired to secure by Letters Patent:

1. In apparatus for abrading a workpiece including a central support member having mounted thereon a power-driven contact roll and an idler roll, and an endless, abrasive belt trained over the rolls with an air space being defined between inside surfaces of the belt and the central support member, the improvement comprising:

sealing means provided adjacent opposite ends of each roll and on opposite sides of the central support member for substantially sealing the air space; and pressurizing means operatively communicating with the air space for maintaining same at a pressure greater than the prevailing air pressure adjacent the outside surfaces of the belt to thereby create a plenum chamber and substantially prevent inflow of abraded debris to the air space.

2. The apparatus of claim 1 wherein said pressurizing means includes air mover means communicating with duct means, said duct means extending into the air space and said air mover means being operable for delivering air into said duct means for discharge into the air space.

3. The apparatus of claim 2 wherein said duct means includes a first duct section which is provided with a discharge opening adjacent said idler roll and a second duct section provided with a discharge opening adjacent said contact roll.

4. The apparatus of claim 3 wherein said first duct section includes a pair of ducts, each being positioned on opposite sides of said central support member.

5. The apparatus of claim 3 wherein said duct means also includes a transfer duct mounted exteriorally of the belt which communicates with said air mover means and said first and second ducts.

6. The apparatus of claim 1 wherein said sealing means provides surfaces over which inside portions of the belt may travel.

7. The apparatus of claim 6 wherein said sealing means includes elongate members having portions which are arcuately shaped to conform to a peripheral portion of the contact and idler rolls.

8. A method for substantially preventing inflow of abraded debris into an air space in an abrading apparatus, the air space being defined as the entire region between the inside surfaces of an endless, abrasive belt and a central support member, the central support member supporting a power-driven contact roll and an idler roll over which the belt is trained, the method comprising:

substantially sealing the air space; and pressurizing the air space to thereby create a plenum chamber so that the pressure therewithin is greater than the prevailing air pressure adjacent the outside surfaces of the belt.

9. The method of claim 8 wherein said pressurizing step includes delivering air from an air mover means through a duct means and discharging the air into the air space.

10. The method of claim 8 wherein said discharging step includes directing air into the air space at separate locations, one location being adjacent the idler roll and the other location being adjacent the contact roll.

11. The method of claim 8 wherein said discharging step further includes directing the air into the air space on opposite sides of the central support member.

* * * * *